United States Patent [19]

Petersen

[11] Patent Number: 4,461,464

[45] Date of Patent: Jul. 24, 1984

[54] SHEET, OR STACKED SHEET HANDLING APPARATUS

[75] Inventor: Godber Petersen, Augsburg, Fed. Rep. of Germany

[73] Assignee: M.A.N.-ROLAND Druckmaschinen Aktiengesellschaft, Offenbach am Main, Fed. Rep. of Germany

[21] Appl. No.: 421,479

[22] Filed: Sep. 22, 1982

[30] Foreign Application Priority Data

Oct. 31, 1981 [DE] Fed. Rep. of Germany ..... 3143242

[51] Int. Cl.[3] ..... B42C 1/04

[52] U.S. Cl. ..... 270/47

[58] Field of Search ..... 270/47, 48, 13, 14, 270/19, 38

[56] References Cited

U.S. PATENT DOCUMENTS

| | | | |
|---|---|---|---|
| 1,439,580 | 12/1922 | Schwartz | 270/47 |
| 1,717,257 | 6/1929 | Rasmussen | 270/47 |
| 2,019,930 | 11/1935 | Quick et al. | 270/38 |
| 3,263,988 | 8/1966 | Heimlicher | 270/13 X |
| 4,211,396 | 7/1980 | Michalik | 270/13 |

FOREIGN PATENT DOCUMENTS

| | | | |
|---|---|---|---|
| 2500964 | 7/1976 | Fed. Rep. of Germany | 270/47 |
| 2714915 | 10/1978 | Fed. Rep. of Germany | 270/47 |
| 2936768 | 4/1981 | Fed. Rep. of Germany | 270/13 |

OTHER PUBLICATIONS

"Atlas of Newspaper and Illustration Printing" pp. 96, 97 published by Polygraph, 1960.

*Primary Examiner*—E. H. Eickholt

*Attorney, Agent, or Firm*—Frishauf, Holtz, Goodman & Woodward

[57] ABSTRACT

To positively guide removal of sheets, or packages of sheets retained against a circumference of a sheet handling cylinder, which may be a folding cylinder (1) or a cutter cylinder, a belt system comprising guide belts (11) is guided to a position within the circumferential outline of the sheet handling cylinder, guided therein by sets of guide rollers (13, 14, 15) close to the circumference, to leave the interior of the folding cylinder at a removal station (B) and thereby lift the leading edge (8) of sheets held against a circumference of the folding roller for example by external belts (9) and holding grippers (7) off from the folding cylinder for transport to a conveyer belt system for further removal. The belts (11) which operate partly outside, partly inside the folding cylinder (1) operate, preferably, at the same circumferential or linear speed.

9 Claims, 3 Drawing Figures

SHEET, OR STACKED SHEET HANDLING APPARATUS

Reference to related publications:

German published patent application No. 25 12 368

German Pat. No. 477,102

"Atlas of Newspaper and Illustration Printing," published by Polygraph, Verlag, Germany, 1970, PP 96, 97.

Reference to related application:

Ser. No. 421,393 Filed Sept. 22, 1982, Petersen "Printing Substrate Handling, Particulary Sheet Folding Apparatus" claiming priority German Application No. P 31 43 243.3, 31 October 1981 the disclosure of which is hereby incorporated by reference.

The present invention relates to paper handling apparatus and more particularly to sheet folding apparatus in which sheets are transported to a sheet collection cylinder, which grips the sheets at their leading edge, the sheet collection cylinder having a circumferential point where it comes in contact with a sheet folding cylinder, and a folding edge or blade presses the sheet, upon release of the leading edge, into a folding groove of the sheet folding cylinder which grips the fold for then transporting the sheet with the fold or creased edge first along the circumference of the folding cylinder.

BACKGROUND

Various types of folding apparatus using rotary elements have been proposed. German Published Patent Application DE AS No. 25 12 368 describes a folding apparatus in which a collection cylinder cooperates with conveyor belts, tapes or the like which press printed material which is folded, or to be folded against a circumference thereof. It is desirable to guide the material on the collection cylinder as long as possible, and preferably up to a transfer position to the surface of a further receiving cylinder. Such a receiving cylinder may be a transfer cylinder, or a folding cylinder as such.

It has previously been proposed to arrange guide tongues or guide fingers between the cylinder which releases a sheet and the cylinder which receives a sheet, so that the sheet is guided along the surface of the respective cylinder as long as possible. Such guide fingers have the disadvantage that their finite geometric form cannot guide the sheet to be transferred up to the transfer position at the surface of the transferring cylinder, so that precise guidance of the sheet becomes difficult and sometimes impossible.

THE INVENTION

It is an object of the present invention to provide a sheet handling apparatus which has a sheet guiding system which permits exact guidance of sheets to be transferred, and, preferably, guidance of the sheet close to an even up the transfer position.

Briefly, a sheet handling, or folding cylinder is provided in form of an open construction which permits endless conveyor tapes, belts, webs, ropes, or cables to pass within the circumference of the cylinder, to be guided therein e.g. by a plurality of rollers which are located closely adjacent the circumferential contour of the folding cylinder, but inwardly of the circumference. Upon rotation of the rollers with the cylinder, the endless conveyor means will be guided within the cylinder at angles which, with respect to a tangent of the sheet folding cylinder, will change so that the conveyor means will, during rotation of the folding cylinder, properly guide a folded sheet.

In accordance with a feature of the invention, at least one external guide rollers is provided, located outside of the circumference of the folding cylinder and adjacent a sheet removal position, and so located that a run of the endless conveyor will pass out of the circumferential portion of the sheet handling cylinder in tangential direction, to lift the sheet off the circumference of the sheet handling cylinder for subsequent transport, as desired.

As used herein, the term "sheet" is to be deemed to include not only a single sheet, but may include a package or stack of sheets; the singular will be used for ease of explanation although, of course, it is understood that a plurality of superimposed or stacked sheets may be processed in the same manner as a single sheet.

The endless conveyor preferably is formed of a plurality of parallel running belts, webs, cables, ropes or tapes; for simplicity, the term "belt" or "belts" will be used, although it is not to be construed in a limiting sense, but also to include such conveyance means as ropes or cables.

DRAWINGS

DETAILED DESCRIPTION

Figure 1:
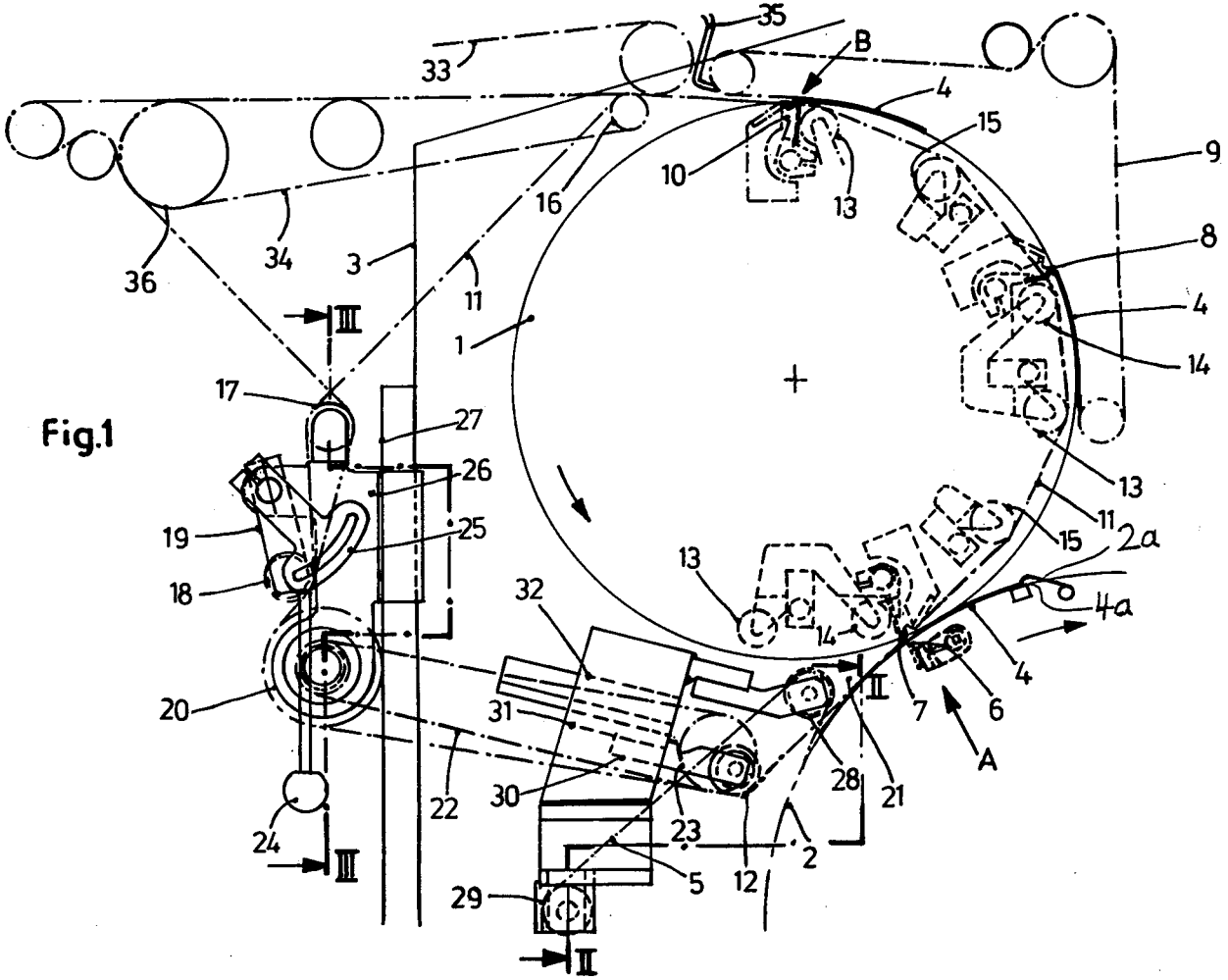
FIG. 1 is a side view of a folding cylinder apparatus.
Figure 2:
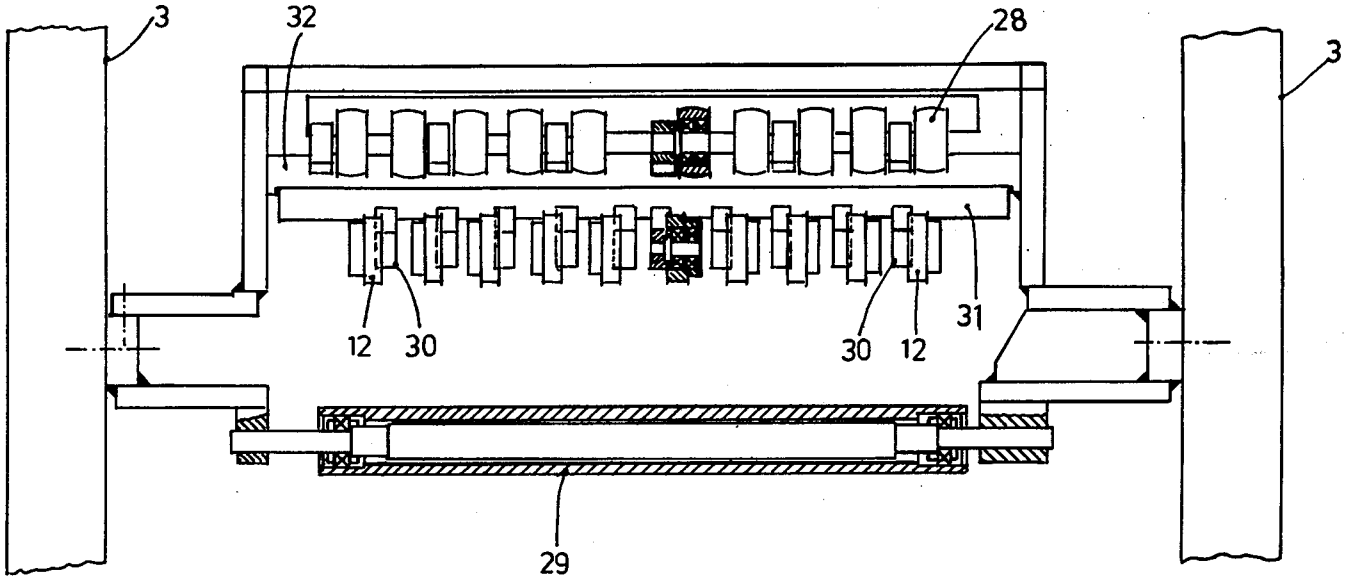
FIG. 2 is a cross section along line II—II of FIG. 1, in which it is to be noted that the section line is broken, or offset.
Figure 3:
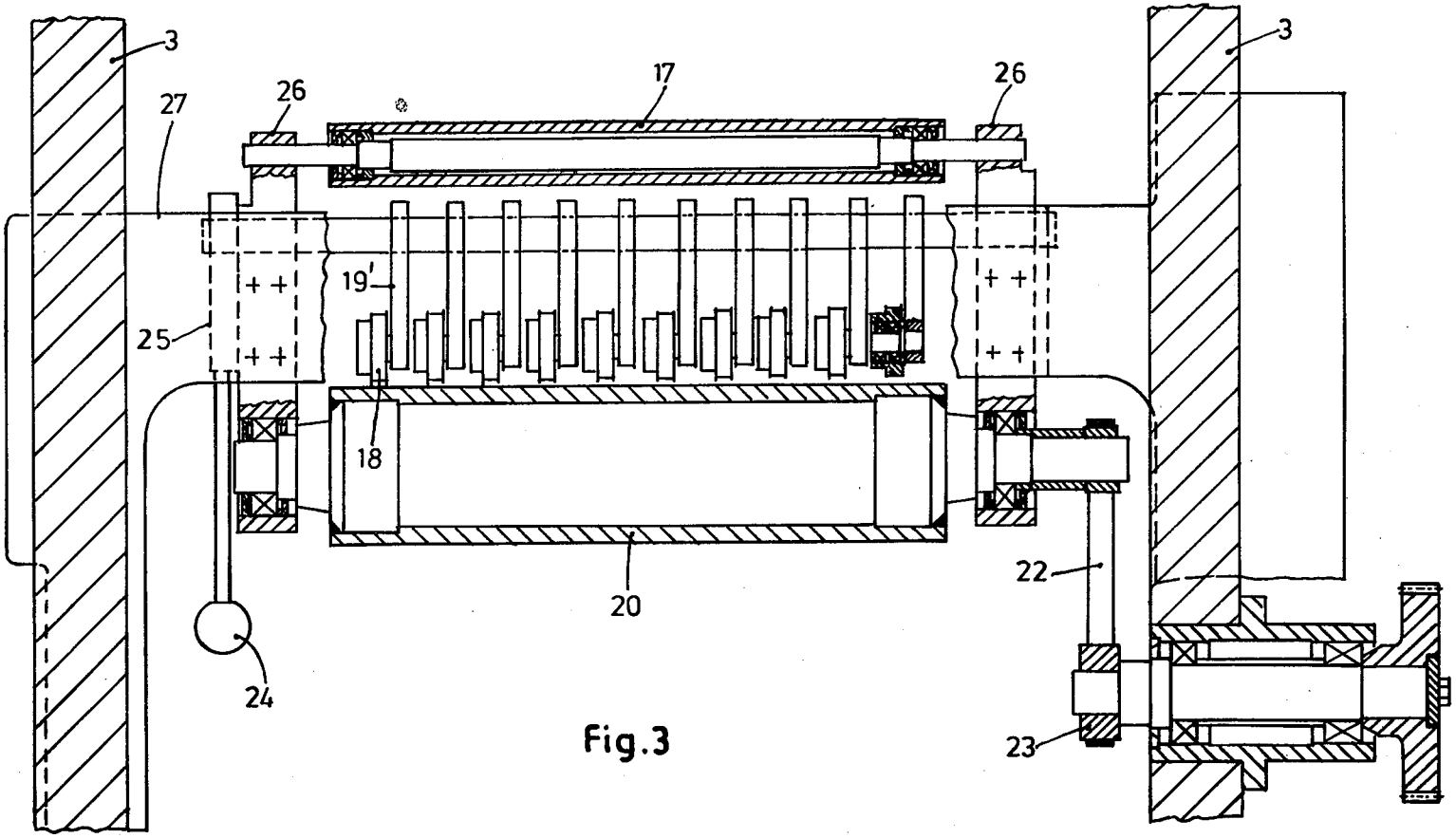
FIG. 3 is a section along line III—III of FIG. 1, the section likewise being offset.

A rotating sheet collection cylinder 2, shown only in fragmentary representation in FIGS. 1, 2 and 3, as well as a folding cylinder 1—see FIGS. 1–3—are located between side walls 3 (see FIG. 2) or frame structures, in accordance with well-known arrangements. The present invention will be described in connection with sheets 4 held, as customary, by sheet grippers 2*a* on the collection cylinder at the leading edge 4*a* of the sheet. When the sheets 4, upon rotation of cylinder 2, reach a predetermined position, the sheets 4 are creased and transferred at the contact line A between the cylinders 1, 2, and transferred by the gripper cylinder 2 to the folding cylinder 1. The gripper cylinder 2 rotates in clockwise direction, the folding cylinder 1 in counter clockwise direction. The crease and transfer results in a transverse fold line in the sheet. The grippers 2*a* then release the leading edge of the sheet 4 so that, as the creased edge is held by grippers on the folding cylinder, the sheet 4 will be transported along the circumference of the folding cylinder 1 in folded manner. The sheet 4 is held in contact with the circumference of the gripper cylinder 2 by conveyor belts 5. When the predetermined position on the sheet 4 reaches the contact line A, a creasing blade 6 is operated, for example by a cam, the creasing blade 6 extending from the inside of the cylinder 2 towards the circumference of the folding cylinder 1, the crease being gripped by folding fingers or strips 7, so that the sheet 4 is transferred to the folding cylinder 1 with the leading edge formed by an intermediate crease line. The sheets 4 are then gripped at the leading edge 8 by grippers 7 on the folding cylinder.

The grippers 2*a* can release the leading edge of the sheet as the crease is formed by the creasing blade 6 to then hold the newly developed leading fold line 8 of the sheet on the folding cylinder 1 by the folding grippers or foldingholder strips 7.

The folded sheets, or stacks of sheets 4 which are located on a circumference of the folding cylinder 1 are removed from the folding cylinder 1 at a removal position or removal line B. First, however, the clampped leading creased edge 8 must be removed from the folding strips or fingers in the folding cylinder 1. The sheets are held in contact with the circumference of the folding cylinder 1 by a belt arrangement 9.

In accordance with the present invention, an endless conveyor means, or conveyer belt system 11 is provided. The conveyer belt system 11 is guided about a roller 12. Starting from roller 12, the conveyer belt system 11 presses the sheet 4 against the circumference of gripper cylinder 2 in advance of the contact line A. The folding or gripper strip 7 within the folding cylinder 1 may be an axially extending strip or rail; if so, the strip or rail is formed with notches therein to receive and let pass the individual belts 11, located axially staggered one behind the other. The belts 11 then pass through these notches within the circumference of the folding cylinder 1.

The folding cylinder 1, in accordance with a feature of the invention, has a plurality of sets of rollers 13, 14, 15 located within its circumference. Preferably, the leading roller 15 is spaced from the circumference of the cylinder 1 by a greater distance than the rollers 13, 14. Rollers 13, 14, 15 guide the conveyor belt 11 within the contour of the gripper cylinder 1 until the belt 11 leaves again the interior of the gripper cylinder 1 at the delivery or removal position B. The conveyor belt 11 then is guided over a further guide or deflection roller 16.

The conveyor belt 11 is an endless belt, and, from roller 16 is guided over a roller 17, over a tension or adjustment roller 18, secured to levers 19, and over another roller 20 back to the roller 12.

In accordance with a feature of the invention, roller 12 guides the conveyor belt 11 into the space 21 just in advance of the contact line A, so that the sheet, which is to be transferred to the folding cylinder 1, is guided and held in contact with the gripper cylinder 2 until close to transfer, that is, practically until the folding blade 6 engages the sheet 4 to form the crease and transfer the intermediate portion of the sheet to the folding grippers 7.

Rollers 13, 14, 15 secured within the cylinder 1 by suitable brackets shown only in broken line and chain dotted outline in FIG. 1, are so arranged, in accordance with a preferred feature of the invention, that they have different distances with respect to the surface of the folding cylinder 1. Consequently, the belt 11 will penetrate within the cylinder 1 by different amounts as it is engaged by different ones of the rollers. Thus, the angle of entry of the belt 11 into the folding cylinder 1 will depend on the particular one roller then engaged, and its position within the folding cylinder 1. By suitable placement and arrangement of the rollers 13, 14, 15, thus, it is possible to guide the belt 11 to enter within the circumference of cylinder 1 by a deeper extent, that is, with a steeper angle—with respect to a tangent of the cylinder 1 at the contact line A—when the folding blade 6 engages within the circumference of the folding cylinder 1. The folding and creasing operation of the sheet, thus, is not interferred with by the presence of the conveyor belts.

Roller 12 is fixed within the sidewalls of the machine and, preferably, can be so adjusted that the belts 11 press the sheet 4 on the gripper cylinder 2 but, on the other hand, do not interfer with the passage of the folding blade 6 into the cylinder 1, during folding operation.

The optimum position of the belt 11 can be obtained by suitable positioning of the rollers 13, 14, 15 within the cylinder 1.

Drive—as best seen in FIGS. 1 and 3—is obtained by driving the roller 20 from a tooth belt 22 which, in turn, is driven by a gear or tooth belt 23. Tension of the belts of the conveyer system 11 is controllable by a lever 24 which acts on tension rollers 18. A desired lever position is then determined by clamping lever 24, and rollers 18 by clamping the rollers 18 in a clamping lever 25, by a suitable screw clamp (not shown) in accordance with well-known structures. The holders 25 are secured by a clamping holder 26 to a frame 27 which, in turn is connected with the sidewalls 3 of the apparatus—see FIG. 3.

The belts 5 are secured to rollers 28 and to a roller 29. The belt 11 extend over the roller 12. Both belts 5, 11 preferably operate at the same speed and pass each other, that is, they are axially staggered with respect to each other—see FIG. 2. Rollers 12 are secured to lever 30 which, in turn, are secured to a support structure 31, moveably, preferably slideably seated on a carrier 32. Thus, all the rollers 12 can be repositioned so that their respective orientation and location with respect to the cylinders 1 and 2 can be changed, in order to obtain optimum matching of the passage and course of the conveyer belts. The support carrier 32 provides for holding rollers 29 and 28; carrier 32 is secured to the walls, or frame structure of the apparatus.

Removal or release of the creased sheets at the removal position B is best seen in FIG. 1. The belts 11 are guided beneath the folder sheet 4 in the folding cylinder 1 at the removal position B approximately tangentially out of the folding cylinder and to the roller 16. Consequently, as the belts 11 leave the circumference of the cylinder 1, and the folding strips or rails 7 open, the belts 11 will lift the creased edge of the sheet 8 off the circumference of the cylinder 1. The linear speed of the belts 11 and of the cylinder 1, and hence of the sheet 4 is at lease approximately the same, preferably exactly the same. Thus, no substantial relative speed between the belts 11 and the sheet 4 will result. This prevents shock-like engagement of the leading edges of the folding sheets with removal tongues or tines, or other removal conveyer apparatus. The system handles the sheets gently, so that smear of freshly printed sheets is prevented.

The sheet removal position B, located at the circumferential location 10, thus provides for gentle forcing of the leading creased edge 8 of the sheet off the circumference of the folding cylinder 1. The folding strips 7, of course, have opened. The trailing ends of the sheets are still held against he circumference of the folding cylinder 1 by the guide belt 9, so that the leading folding edge 8 is fed tangentially between belt systems 33, 34 from where the sheets can be transported further, for example to paddle wheels, or other transport elements. Hold-down tongues 35 may be provided to limit the upper transfer space for distance.

The lower guide conveyers 34 are driven from a roller 35.

Separate conveyer systems 34 are not necessary; and in some arrangements the belts 11 can be guided about the drive roller 36, so that a separate drive mechanism is not needed. The belts 11, thus, can take over the function of the belts 34. The reverse, of course, is also possible, namely to guide the belts 34 in the path shown for the belts 11, past the gripper cylinder 2 and through the folding cylinder 1. Other belt systems can be used, guided as described, for example the belt system 5 can be guided through the folding cylinder 1 and, under some arrangements, can also take over the function of the belt system 34.

The folding cylinder 1, thus, in accordance with a feature of the present invention, has guide rollers 13, 14, 15 located within its circumference, to permit penetration of belt 11—or an equivilent belt or belt system within the circumference of the folding cylinder. By guiding the belt 11, as described in connection with guide roller 12, in accordance with a feature of the invention, the sheet 4 is optimumly guided first on the gripper cylinder 2 until almost to the transfer position A, and then continues to be guided at the trailing portion while the then folded edge 8 of the sheet is received in the folding cylinder, without interference with the belt 11 which is then guided internally of the circumference of the folding cylinder 1 by the roller system 13, 14, 15. In accordance with a feature of the invention, and preferably, three rollers 13, 14, 15 are provided, although a lesser number may suffice; preferably the leading roller, here roller 15 is spaced from the circumference of the folding cylinder 1 by a greater distance than the trailing roller, here roller 13, or rollers provided and located intermediate the leading and trailing rollers. "Leading" and "trailing" here refer to the position of the rollers with respect to a folded sheet, or the direction of rotation, respectively.

It should be stressed again that the reference to "belts 11" equally includes other types of conveyer arrangements, such as ropes, cables, which may be wire-type cables or other endless conveyer structures, and that the use of the term "belts" in the specification and the claims to follow is to be deemed to be inclusive, used to simplify wording and provide for a readily visualized description.

Removal of the folded sheets from the folding cylinder is positively guided. It has previously been proposed—see "Atlas of Newspaper and Illustration Printing", published by Polygraph, Verlag, Germany, 1970, PP 96, 97—to remove folded sheets, or packages of sheets by removal tongues which are then transferred to a paddle, or gripper holding structure. Such removal structures cause impingement of the leading edges of the sheets, or package of sheets against a stationary or path deflecting element. Damage to the leading edges 8 of the folded sheets or packages may occur.

The apparatus in accordance with the present invention can operate at substantially higher speed with gentle handling of the paper products. Typical operating speeds can be in the order of 40,000 revolutions per hour (roughly 650 rpm). Even at that high speed, the separation of printed material to be folded, then folding, and removal of the folded printing material can be carried out gently, and without damage to the printed subject matter or to the carrier material. Thus, separation from the respective cylinders is entirely feasible. By guilding the leading folded edge with a belt 11 which reaches the removal position from within the folding cylinder, the material can be removed in essentially tangential direction with respect to the surface of the folding cylinder, and hence without shock, or impingement on further transport apparatus. The belt system formed by belts 11 and 33 and 34 thus can provide for shock-free removal of the leading edge of the folded sheet, or package of sheets from the folding cylinder at the same operating speed as the folding cylinder, by merely driving the speed of the respective belts 11, 33, 34 at essentially the same, and preferably exactly the same linear speed as the surface speed of the folding cylinder 1. The only stress being placed on the sheet 4 or package of sheets will be a radially acting component, which assists in removal of the folded leading edge 8 from the folding rail 7, further assisted by the belts 11 which will leave the interior of the folding cylinder 1 in an tangential direction. The radial components are accepted by the belt 33—see FIG. 1.

The guide roller 16 can be positioned close to the folding cylinder 1. The belt system 33, 34, axially interlaced with respect to the belts 11 positively guides the sheet after the sheet, or package of sheets leaves the belt 11 for further removal and transport in accordance with any desired manner. The sheets, upon removal, are guided at the upper circumference by the belt system 9 for essentially immediate subsequent transfer to the belt 33; of course, the belt 9 can be extended to run parallel to the belt 34, and above the belt 11, thus providing for continued guidance, with the top holding tongues 35 interlaced with respect to a plurality of individual belts, tapes, rolls or cables which form the belt system 9, 11, 33, 34, respectively.

The invention has been described in connection with cut sheets. In the example described, the belts 11 are guided through a folding cylinder 1. The belt guiding arrangement, by using the operating principles of the present invention, can also be used with a pair of cutter cylinders. The belts, or belt systems, then, after cutting of sheets from a web can be led out from the cutter cylinder at the removal position B as described from the circumference of one of the cutter cylinders. Rather than using rollers 13, 14, 15, it is then only necessary to use guide grooves, for example for belts or wire ropes, since the cutter cylinders themselves would effect drive and movement of the printed material or substrate.

Various changes and modifications may be made and features described with respect to folding and gripping of sheets, and removal of sheets, respectively, can be used independently of each other, within the scope of the inventive concept.

I claim:

1. Sheet handling apparatus having a rotating first cylinder (2);

means (2a) retaining a substrate web on said first cylinder;

a rotating sheet handling cylinder (1), located to form a contact line (A) with said first cylinder;

sheet handling and transfer means (6) transferring a substrate, in sheet form, to said sheet handling cylinder;

holding means (7, 9) retaining at least a leading edge of the sheet on the circumference of the sheet handling cylinder for transport of the sheet thereon;

and comprising, in accordance with the invention means for removing the sheet from surface contact with the circumference of the sheet handling cylinder (1) including an endless conveyer belt system including a plurality of parallel conveyer belts (11);

conveyer belt guide means (13, 14, 15) located within, and closely adjacent to the circumferential contour of the sheet handling cylinder (1) and rotating with said sheet handling cylinder;

an external guide means (16) located outside of the circumference of said rotating sheet handling cylinder, having said conveyer belts passing thereover, and positioned to guide the conveyer belts in essentially tangential direction with respect to the circumference of the sheet handling cylinder at the exit line of the belts from the interior of said handling cylinder, for guiding the sheets and removal by the belts (11) of the belt system as the belts leave the interior of the handling cylinder and are guided towards said external guide means (16).

2. Apparatus according to claim 1 wherein said conveyer belt guide means (13, 14, 15) include a plurality of rollers, located within and closely adjacent the circumferential contour of the sheet handling cylinder, the rollers being positioned in sets, the sets of rollers being located, sequentially, along the circumference of the sheet handling cylinder.

3. Apparatus according to claim 2 wherein the endless conveyer belts (11) of the conveyer belt system are guided by the sets of the rollers from an entry position into the interior of said sheet handling cylinder, located adjacent said contact line, and up to the removal, or exit line of the belts in advance of passage over said external guide means (16).

4. Apparatus according to claim 2 wherein said external guide means comprises a guide roller (16).

5. Apparatus according to claim 1 wherein the first cylinder comprises a gripper cylinder (2) and the sheet handling cylinder (1) comprises a folding cylinder having folding grippers or rails (7) to receive sheets at a crease line, which forms the leading edge (8) of the sheets when folded.

6. Apparatus according to claim 3 wherein the first cylinder comprises a gripper cylinder having a folding blade (6) located thereon;

said sheet handling cylinder comprises a folding cylinder (1) having a fold gripper (7) located thereon to receive a creased edge of a sheet creased by said creasing blade (6) which forms the leading edge (8) of a sheet being transported along the circumference of the folding cylinder (1);

and wherein the belts (11) of the belt system are guided into the interior of the folding cylinder (1) adjacent said contact line (A), said conveyer belt guide means comprise sets of guide rollers (13, 14, 15) guiding the endless belt within the interior of the folding cylinder and up to the exit or removal line (B), the belts (11) exerting a pressing or lifting action against sheets located on the circumference of the folding cylinder at said removal or exit line;

and further including removal conveyer means (33, 34) receiving sheets removed by said belts from the cylinder for further transport.

7. Apparatus according to claim 6 wherein the removal conveyer means includes a drive roller (36);

and said belts are guided about said drive roller.

8. Apparatus according to claim 1 further including belt guide roller means (17, 18, 20, 12) guiding the belts from the external guide means to a location adjacent said contact line for entry within the circumferential outline of said handling cylinder;

and wherein one of said belt guide rollers comprises a tension roller (18).

9. Apparatus according to claim 6 further including belt guide roller means (17, 18, 20, 2) guiding the belts from the external guide means to a location adjacent said contact line for entry within the circumferential outline of said handling cylinder;

and wherein one of said belt guide rollers comprises a tension roller (18).

* * * * *